US005454844A

United States Patent [19]

Hibbard et al.

[11] Patent Number: 5,454,844

[45] Date of Patent: Oct. 3, 1995

[54] ABRASIVE ARTICLE, A PROCESS OF MAKING SAME, AND A METHOD OF USING SAME TO FINISH A WORKPIECE SURFACE

[75] Inventors: Louis D. Hibbard, Eagan; Stanley B. Collins, White Bear Lake; John D. Haas, Woodbury, all of Minn.

[73] Assignee: Minnesota Mining and Manufacturing Company, St. Paul, Minn.

[21] Appl. No.: 145,404

[22] Filed: Oct. 29, 1993

[51] Int. Cl.[6] ..... B24D 3/00; B24D 11/00

[52] U.S. Cl. ..... 51/295; 451/296; 451/528; 451/534; 451/539

[58] Field of Search ..... 51/293, 295; 451/296, 451/528, 534, 539

[56] References Cited

FOREIGN PATENT DOCUMENTS 62-255069 4/1988 Japan ..... B24D 11/00

OTHER PUBLICATIONS

Morozov, *How the Surface Relief Affects Efficiency in Grinding Jobs,* Soviet Eng. Research, vol. 9, No. 6, pp. 103–106, 1989 (No Month).

Tsukada et al, *Geometrical Characterization of High Precision Coated Abrasive Tape,* Digests of Intermag 1992, Apr. 1992.

*Primary Examiner*—Deborah Jones

*Attorney, Agent, or Firm*—Gary L. Griswold; Walter N. Kirn; Ramon R. Hoch

[57] ABSTRACT

An abrasive article having a sheet-like structure having a major surface and having deployed in a fixed position thereon a plurality of abutting abrasive composites in an area spacing of at least 1,200 composites/cm$^2$, each of the composites comprising a plurality of abrasive particles dispersed in a binder. The invention also relates to a method for reducing a surface finish of a workpiece surface using the abrasive article and a process for making the abrasive article of the invention.

18 Claims, 2 Drawing Sheets

ABRASIVE ARTICLE, A PROCESS OF MAKING SAME, AND A METHOD OF USING SAME TO FINISH A WORKPIECE SURFACE

BACKGROUND OF THE INVENTION

1. Field of the Invention

This invention relates to an abrasive article having a sheet-like structure having a major surface with a plurality of abutting abrasive composites deployed thereon. This invention also relates to a process of making such an abrasive article, and a method of using such an abrasive article to provide an improved cut rate and surface finish.

2. Discussion of the Art

In general, abrasive articles comprise a plurality of abrasive particles bonded either together (e.g., a bonded abrasive or grinding wheel) or to a backing (e.g., a coated abrasive). These abrasive articles have been utilized to abrade and finish workpieces for well over a hundred years. One problem that has always plagued the abrasive industry is the generally inverse relationship associated between the cut rate (i.e., the amount of workpiece removed for a given time interval) and the surface finish that is imparted by the abrasive article on the workpiece surface. This explains why there exists a wide range of abrasive products from coarse grit (i.e., relatively large particle size of abrasive particles) to fine grit (i.e., relatively small particle size of abrasive particles). Typically, these different types of abrasive products are sequentially used in an abrading operation to achieve both the desired cut and surface finish.

What is desired by the industry is an abrasive article that gives a relatively high rate of cut, while still imparting a relatively fine surface finish on the workpiece being abraded.

One solution to this problem is disclosed in U.S. Pat. No. 5,152,917 (Pieper et al.). Pieper et al. teach a structured abrasive that is loading resistant and provides a consistency in the surface finish provided in the workpiece surface. The structured abrasive comprises abrasive composites that are bonded to a backing and that have a precise shape. Pieper et al. state a general premise that a higher areal density of abrasive composites tends to produce a lower unit pressure per composite during grinding, therby allowing a finer surface finish. However, Pieper et al. only exemplified a lineal spacing of abrasive composites of about 0.017 inches (0.007 cm), or an areal spacing of only about 536 composites/square centimeter. Pieper et al. indicate that an abrasive article with this spacing of pyramidal shaped composites was thought to satisfy criteria for high cut rate and low surface finish values.

U.S. Pat. No. 3,048,482 (Hurst) discloses an abrasive article comprising a backing, a bond system and abrasive granules that are secured to the backing by the bond system. The abrasive granules are a composite of abrasive grains and a binder which is separate from the bond system. The abrasive granules are three dimensional and are roughly pyramidal in shape. To make this abrasive article, the abrasive granules are first made via a molding process. Next, a backing is placed in a mold, followed by the bond system and the abrasive granules. The mold has a pattern of cavities therein which results in the abrasive granules having a specified space-apart pattern on the backing.

Great Britain Patent Application No. 2,094,824 (Moore), published Sep. 22, 1982 pertains to a patterned lapping film. A slurry of abrasive and curable binder resin is prepared and the slurry is applied through a mask to form discrete spaced-apart islands. Next, the resin or binder is cured. The mask can be a silk screen, stencil, wire or a mesh.

U.S. Pat. No. 4,930,266 (Calhoun et al.) teaches a patterned abrasive sheeting in which abrasive granules are strongly bonded and lie substantially in a plane at a predetermined lateral spacing. In this disclosure the abrasive granules are applied via an impingement technique such that each granule is individually applied to the abrasive backing in a spaced relationship. This results in an abrasive sheeting having a precisely controlled spacing of the abrasive granules. An area spacing of 870 granules/square centimeter is described by Calhoun et al.

U.S. Pat. No. 5,107,626 (Mucci) teaches a method of providing a patterned surface on a substrate by abrading with a coated abrasive containing a plurality of precisely shaped abrasive composites. The abrasive composites are in a non-random array and the abrasive composites comprise a plurality of abrasive grains dispersed in a binder.

U.S. Pat. No. 5,219,462 (Bruxvoort et al.) teaches a method for making an abrasive article. A slurry is coated substantially only into recesses of an embossed backing. The abrasive slurry comprises a binder, abrasive grains and an expanding agent. After coating, the binder is cured and the expanding agent activated. This causes the slurry to expand above the surface of the embossed backing to assume a mushroom-like or spherical-like shape. The recesses, when unconnected to necessarily form space-apart composites, are disclosed as typically having an area spacing of 2 to 10,000 recesses/cm$^2$, preferably 100 to 1,000 recesses/cm$^2$. Alternatively, the recesses can be connected or linked together to form linearly elongated recesses having a linear spacing of 2 to 100 recesses/cm.

Japanese Patent Application No. S63-235942, published Mar. 23, 1990, teaches a method of a making a lapping film having a discontinuous raised pattern of abrasives. An abrasive slurry is coated into indentations in a tool. A backing is then applied over the tool and slurry containing abrasive grains and curable binder is cured to provide a coated abrasive which is removed from the tool. The binder can be cured by radiation energy or thermal energy to form a networked layer of abrasive material.

Japanese Patent Application No. JP 4-159084 published Jun. 2, 1992 teaches a method of making a lapping tape. An abrasive slurry comprising abrasive grains and an electron beam curable resin is applied to the surface of an intaglio roll or indentation plate. Then, the abrasive slurry is exposed to an electron beam which cures the binder and the resulting lapping tape is removed from the roll to form a networked layer of abrasive material.

European Application 554,668, published Aug. 11, 1993 (Calhoun) teaches a method of making an abrasive article. A slurry of abrasive grains and curable binder is coated into recesses of an embossed substrate used as a molding surface. The recesses are separated from each other and can have a spacing of 2 to 10,000 recesses per square centimeter. The abrasive slurry forms abrasive composites which, upon solidifying of the binder, are entirely separate from each other, and which are then cured with the composites being maintained in a separated state. The embossed surface is then urged against an adhesively-coated backing layer such that the cured abrasive composites are then adhesively bonded to the backing layer. The embossed substrate is separated from the backing and the spaced-apart abrasive composites remain adhered to the backing with no contacting or abutting portions between the composites.

U.S. application Ser. No. 08/120,300 (Hoopman), filed Sep. 13, 1993, relates to an abrasive article where the abrasive composites have precise shapes, but the shapes are not all identical.

U.S. Ser. No. 08/067,708 (Mucci), filed May 26, 1993, pertains to a method of polishing a workpiece using an abrasive article. The abrasive article comprises a plurality of precisely shaped abrasive composites bonded to a backing. During polishing, the abrasive article is oscillated.

However, there remains a need for an abrasive article that can provide a high cut rate while imparting a fine surface finish in a workpiece surface where the arrangement of the abrasive composites does not necessitate a complete physical separation thereof and which encompasses very high densities of abrasive composites.

SUMMARY OF THE INVENTION

This invention relates to an abrasive article having a sheet-like structure having a major surface with at least 1,200 abutting abrasive composites per square centimeter deployed thereon. This abrasive article imparts a relatively fine surface on a workpiece being abraded while providing a high rate of cut. The contemperaneous achievement of fine finish with high cut rate by a single abrasive article as in this invention is surprising and counterintuitive to the conventional wisdom in the abrasive field.

For purposes of this invention, the term "abutting" means that adjacent abrasive composites at least have portions, e.g., the base portions, that are in physical contact. In the preferred embodiment of the abrasive article of the invention, this physical contact involves no more than 33% of the vertical height dimension of each contacting composite. More preferably, the amount of physical contact between the abutting composites is in the range of 1 to 25% of the vertical height of each contacting composite. It is to be understood that this definition of abutting also covers an arrangement where adjacent composites share a common abrasive material land or bridge-like structure which contacts and extends between facing sidewalls of the composites. Preferably, the land structure has a height of no greater than 33% of the vertical height dimension of each adjacent composite. The abrasive material land is formed from the same abrasive slurry used to form the abrasive composites. The composites are "adjacent" in the sense that no intervening composite is located on a direct imaginary line drawn between the centers of the composites.

In one embodiment of the abrasive article of this invention, an abrasive article comprises a sheet-like structure having a major surface and having deployed in a fixed position thereon a plurality of abutting abrasive composites in an area spacing of at least 1,200 composites/cm$^2$, said composites each comprising a plurality of abrasive particles dispersed in a binder.

In a further embodiment of the invention, the area spacing of composites is at least about 3,000 abrasive composites/cm$^2$, more preferably at least about 4,600 abrasive composites/cm$^2$, even more preferably at least about 7,700 abrasive composites/cm$^2$ and most preferably at least about 8,850 abrasive composites/cm$^2$. In another embodiment, the area spacing of the composites can be from 1,200 to 10,000 abrasive composites/square centimeter. Further, the height of the composites can be a value up to about 200 micrometers, and where the shapes of the composites are pyramidal or truncated pyramidal, the base side lengths generally can have a length of from about 100 to 500 micrometers.

In another embodiment of the invention, each of the abrasive composites include:

(a) a base side in planar contact with the aforesaid major surface, which extends in a first imaginary plane, to define a first surface area, and (b) a distal end spaced from the major surface and located within a second imaginary plane extending parallel to the first imaginary plane to define a second surface area, wherein the first surface area is equal to or larger than the second surface area.

In a one preferred embodiment, the composites have a precise shape defined by a distinct and discernible boundary. In a preferred embodiment, the composites have identical precise shapes. In one further embodiment, the composites each can have a pyramidal shape or truncated pyramidal shape. In another further embodiment, each composite has substantially the same height distance measured between its base side and its distal end.

In another embodiment of abrasive article of the present invention, the abrasive article is in an endless belt form.

In yet another embodiment of the invention, there is a method for reducing a surface finish of a workpiece surface comprising the steps of:

(a) bringing into frictional contact a workpiece surface and an abrasive article, wherein the abrasive article comprises a sheet-like structure having a major surface and having deployed in a fixed position thereon a plurality of abutting abrasive composites in an area spacing of at least 1,200 composites/cm$^2$, each of the composites comprising a plurality of abrasive particles dispersed in a binder.

As yet another embodiment of the invention, there is a process for making an abrasive article of the invention, comprising the steps of:

(a) preparing an abrasive slurry comprising a plurality of abrasive particles dispersed in a binder precursor;

(b) providing a backing having a front surface and a back surface, and a production tool having a major surface extending in a first imaginary plane, the production tool having a surface which is provided with a plurality of individual indented portions extending in a direction normal to the first imaginary plane to define a plurality of cavities in an area spacing of at least 1,200 cavities/cm$^2$, and with the indented portions abutting one another within the first imaginary plane;

(c) providing means to apply the abrasive slurry into a plurality of the cavities;

(d) contacting the front surface of the backing with the production tool such that the abrasive slurry wets the front surface;

(e) solidifying the binder precursor to form a binder, whereupon solidification the abrasive slurry within said cavities providing a plurality of abrasive composites; and (f) separating the production tool from the backing after the solidifying to provide a plurality of abutting abrasive composites as attached to the front surface in an area spacing of at least 1,200 composites/cm$^2$.

Other features, advantages, and constructs of the invention will be better understood from the following description of the drawings and the preferred embodiments of the invention.

DETAILED DESCRIPTION OF THE PREFERRED EMBODIMENTS

Figure 1:
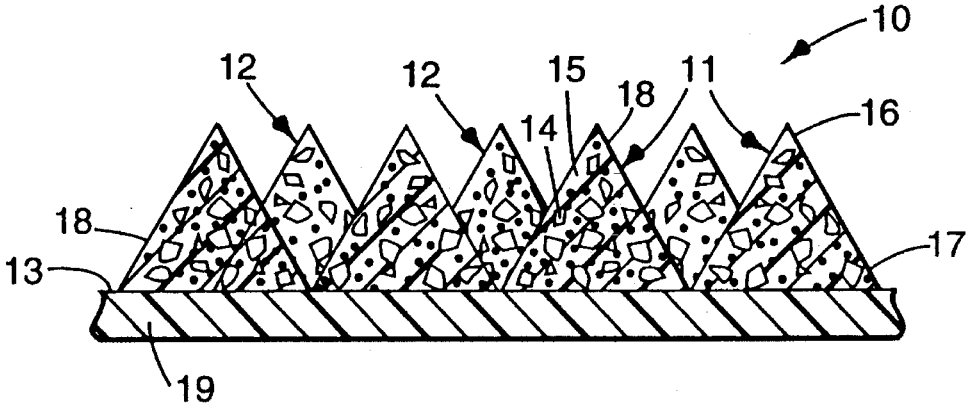
FIG. 1 is an enlarged end sectional view representing one type of abrasive article of this invention.

Referring to FIG. 1, abrasive article 10 has a backing 19 having a front surface 13 having a plurality of abrasive composites 11 bonded thereto. The front surface 13 extends within an imaginary plane. As shown in FIG. 1, each abrasive composite abuts an adjacent composite near the bottom portions thereof (the lowermost portions of which are in contact with the backing).

Preferably, the amount of physical contact between the abutting composites in the abrasive article of the invention does not exceed 33% of the vertical height of either of the given contacting or abutting composites as measured from the front surface of the backing. That is, the preferred height dimensions described herein on the abutting contact applies to each adjacent composite, not merely one. If the abutting composites contact in amounts exceeding 33% of the vertical height of each composite, the swarf discharge capability of the abrasive article may be adversely impacted to cause loading problems. Loading is a problem caused by filling of spaces between abrasive features with swarf (i.e., material removed from the workpiece being abraded) and the subsequent build-up of that material. This build-up of such loose abraded material can lodge between the abrasive features to impair the cutting ability of the abrasive features. On the other hand, some physical contact is required between adjacent abrasive composites of the invention to facilitate providing a high areal density of the composites over the surface of the backing. A higher areal density of composites tends to produce a lower unit pressure per composite during abrading, thereby allowing a finer surface finish. More preferably, the amount of physical contact between the abutting composites is in the range of 1 to 25% of the vertical height of each contacting composite.

Figure 2:
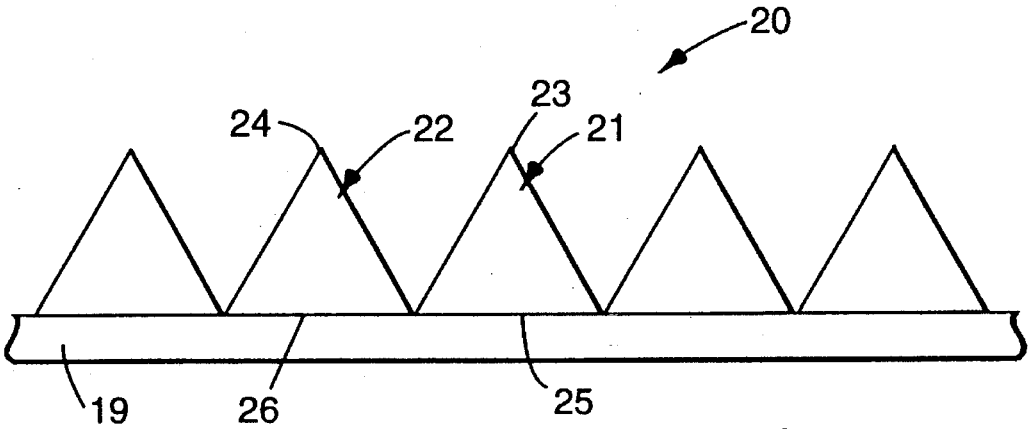
FIG. 2 is an enlarged end sectional profile view representing an alternate embodiment of an abrasive article of this invention.

Also, the definition of "abutting", for purposes of this invention, not only encompasses the arrangement of composites such as depicted in FIGS. 1–2, but also covers an arrangement where adjacent abrasive composites (at least two) share a common abrasive material land or bridge-like structure which contacts and extends between facing sidewalls of the adjacent composites. The abrasive material land is formed from the same slurry as which form the abrasive composites. Preferably, these land structures have a height from the backing which is no more than 33%, preferably 1 to 25%, of the height of each adjacent composite. For example, in adjacent composites having the same pyramidal shape with a height of approximately 79 micrometers and base edge lengths of approximately 178 micrometers, the land can have a height of approximately 20 micrometers, a length of approximately 25 micrometers, and a width no greater than 178 micrometers (the based edge length).

It has been discovered, quite surprisingly, that the abrasive article of the invention employing at least 1200 abutting composites/cm$^2$ provides an advantageous cut rate while providing a finer finish. As shown in FIG. 1, the abrasive composites comprises a plurality of abrasive particles 14 dispersed in the binder 15. The abrasive composites are precisely-shaped in FIG. 1. The base side 17 of the abrasive composite is in planar contact with the front surface 13 of the backing 19, and it has a total given surface area defined by those bottom surface portions of the base side which are in intimate contact with the backing. Distal end 16 is spaced from the backing 19 and is unconnected to the ends of any other composites in the array. The distal end 16 has a given total surface area located within another imaginary plane that extends parallel to the front surface. It will be understood that if the composite has a pyramidal shape which terminates in an apex point spaced away from the backing that the surface area of such an apex will be exceedingly small and approach a value of zero.

Preferably, the surface area of the base side of each of the composites is equal to or greater in amount than that of the distal end. Even more preferably, the precise shapes of the composites are tapered. That is, it is preferred that the surface area of the base side is greater in amount that the surface area of any other cross-sectional slice of the composite taken in a plane parallel to and vertically spaced from said interface of the base side and the backing.

For purposes of this invention, the expression "precisely-shaped", and the like, is used to describe the abrasive composites having a three dimensional shape that is defined by relatively smooth-surfaced sides that are bounded and joined by well-defined sharp edges having distinct edge lengths with distinct endpoints defined by the intersections of the various sides. The abrasive article of this invention is referred to as "structured" in the sense of the deployment of a plurality of such precisely-shaped abrasive composites in a predetermined array on the backing. Such a precies shape can be formed, for example, by curing the curable binder of a flowable mixture of abrasive particles and curable binder while the mixture is both being formed on a backing and filling a cavity on the surface of a production tool.

For purposes of the present invention, the term "boundary", used to define the abrasive composites, means the exposed surfaces and edges of each composite that delimit and define the actual three-dimensional shape of each abrasive composite. These boundaries are readily visible and discernible when a cross-section of an abrasive article of this invention is viewed under a scanning electron microscope. These boundaries separate and distinguish one abrasive composite from another even if the composites abutt each other along a common border at their bases. By comparison, in an abrasive composite that does not have a precise shape, the boundaries and edges are not definitive, e.g., where the abrasive composite sags before completion of its curing.

Backing

The backing of this invention has a front and back surface and can be any conventional abrasive backing. Examples of such include polymeric film, primed polymeric film, cloth, paper, vulcanized fiber, nonwovens, and combinations thereof. The backing may also contain a known treatment or treatments to seal the backing and/or modify some physical properties of the backing. The backing may also have an attachment means on its back surface to secure the resulting coated abrasive to a support pad or back-up pad. This attachment means can be a pressure sensitive adhesive or a loop fabric for a hook and loop attachment. Alternatively, there may be a intermeshing attachment system as described in U.S. Pat. No. 5,201,101, which is incorporated herein by reference.

The back side of the abrasive article may also contain a slip resistant or frictional coating. Examples of such coatings include an inorganic particulate (e.g., calcium carbonate or quartz) dispersed in an adhesive.

The back side of the backing may be printed with pertinent information according to conventional practice to reveal information such as product identification number, grade number, manufacturer and the like. Alternatively, the front surface of the backing may be printed with this same type of information. The front surface can be printed if the abrasive composite is translucent enough for print to be legible through the abrasive composites.

Abrasive Composite

Abrasive Particles

The abrasive particles dispersed in the composite binder of the invention generally have a particle size ranging from about 0.1 to 1500 micrometers, usually between about 0.1 to 400 micrometers, preferably between 0.1 to 100 micrometers and most preferably between 0.1 to 50 micrometers. It is preferred that the abrasive particles have a Mohs' hardness of at least about 8, more preferably above 9. Examples of such abrasive particles include fused aluminum oxide (which includes brown aluminum oxide, heat treated aluminum oxide, and white aluminum oxide), ceramic aluminum oxide, green silicon carbide, silicon carbide, chromia, alumina zirconia, diamond, silica, iron oxide, ceria, cubic boron nitride, boron carbide, garnet, and combinations thereof.

The term abrasive particles also encompasses the arrangement where single abrasive particles are bonded together to form an abrasive agglomerate. Abrasive agglomerates are further described in U.S. Pat. Nos. 4,311,489; 4,652,275 and 4,799,939, each of which is incorporated herein by reference.

It is also within the scope of this invention to have a surface coating on the abrasive particles. The surface coating may have many different functions. In some instances the surface coatings increase adhesion to the binder, alter the abrading characteristics of the abrasive particle and the like. Examples of surface coatings include coupling agents, halide salts, metal oxides including silica, refractory metal nitrides, refractory metal carbides and the like.

In the abrasive composite there may also be diluent particles. The particle size of these diluent particles may be on the same order of magnitude as the abrasive particles. Examples of such diluent particles include gypsum, marble, limestone, flint, silica, glass bubbles, glass beads, aluminum silicate, and the like.

Binder

The abrasive particles are dispersed in an organic binder to form the abrasive composite. The organic binder can be a thermoplastic binder, however, it is preferably a thermosetting binder. The binder is formed from a binder precursor. During the manufacture of the abrasive article, the thermosetting binder precursor is exposed to an energy source which aids in the initiation of the polymerization or curing process. Examples of energy sources include thermal energy and radiation energy which includes electron beam, ultraviolet light, and visible light.

After this polymerization process, the binder precursor is converted into a solidified binder. Alternatively for a thermoplastic binder precursor, during the manufacture of the abrasive article the thermoplastic binder precursor is cooled to a degree that results in solidification of the binder precursor. Upon solidification of the binder precursor, the abrasive composite is formed.

The binder in the abrasive composite is generally also responsible for adhering the abrasive composite to the front surface of the backing. However, in some instances there may be an additional adhesive layer between the front surface of the backing and the abrasive composite.

There are two main classes of thermosetting resins, condensation curable and addition polymerized resins. The preferred binder precursors are addition polymerized resin because they are readily cured by exposure to radiation energy. Addition polymerized resins can polymerize through a cationic mechanism or a free radical mechanism. Depending upon the energy source that is utilized and the binder precursor chemistry, a curing agent, initiator, or catalyst is sometimes preferred to help initiate the polymerization.

Examples of typical binders precursors include phenolic resins, urea-formaldehyde resins, melamine formaldehyde resins, acrylated urethanes, acrylated epoxies, ethylenically unsaturated compounds, aminoplast derivatives having pendant α,β-unsaturated carbonyl groups, isocyanurate derivatives having at least one pendant acrylate group, isocyanate derivatives having at least one pendant acrylate group, vinyl ethers, epoxy resins, and mixtures and combinations thereof. The term acrylate encompasses acrylates and methacrylates.

Phenolic resins are suitable for this invention and have good thermal properties, availability, and relatively low cost and ease of handling. There are two types of phenolic resins, resole and novolac. Resole phenolic resins have a molar ratio of formaldehyde to phenol of greater than or equal to one to one, typically between 1.5:1.0 to 3.0:1.0. Novolac resins have a molar ratio of formaldehyde to phenol of less than one to one. Examples of commercially available phenolic resins include those known by the tradenames "Durez" and "Varcum" from Occidental Chemicals Corp.; "Resinox" from Monsanto; "Aerofene" from Ashland Chemical Co. and "Arotap" from Ashland Chemical Co.

Acrylated urethanes are diacrylate esters of hydroxy terminated NCO extended polyesters or polyethers. Examples of commercially available acrylated urethanes include UVITHANE 782, available from Morton Thiokol Chemical, and CMD 6600, CMD 8400, and CMD 8805, available from Radcure Specialties.

Acrylated epoxies are diacrylate esters of epoxy resins, such as the diacrylate esters of bisphenol A epoxy resin. Examples of commercially available acrylated epoxies include CMD 3500, CMD 3600, and CMD 3700, available from Radcure Specialities.

Ethylenically unsaturated resins include both monomeric and polymeric compounds that contain atoms of carbon, hydrogen, and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of acrylate resins include methyl methacrylate, ethyl methacrylate styrene, divinylbenzene, vinyl toluene, ethylene glycol diacrylate, ethylene glycol methacrylate, hexanediol diacrylate, triethylene glycol diacrylate, trimethylolpropane triacrylate, glycerol triacrylate, pentaerythritol triacrylate, pentaerythritol methacrylate, pentaerythritol tetraacrylate and pentaerythritol tetraacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryloyl-oxyethyl) isocyanurate, 1,3,5-tri(2-methyacryloxyethyl)-s-triazine, acrylamide, methylacrylamide, N-methylacrylamide, N,N-dimethylacrylamide, N-vinylpyrrolidone, and N-vinylpiperidone.

The aminoplast resins have at least one pendant α,β-unsaturated carbonyl group per molecule or oligomer. These unsaturated carbonyl groups can be acrylate, methacrylate, or acrylamide type groups. Examples of such materials include N-(hydroxymethyl)-acrylamide, N,N'-oxydimethylenebisacrylamide, ortho and para acrylamidomethylated phenol, acrylamidomethylated phenolic novolac, and combinations thereof. These materials are further described in U.S. Pat. No. 4,903,440 and U.S. Pat. No. 5,236,472, which are incorporated herein by reference.

Isocyanurate derivatives having at least one pendant acrylate group and isocyanate derivatives having at least one pendant acrylate group are further described in U.S. Pat. No. 4,652,274, which is incorporated herein by reference. The preferred isocyanurate material is a triacrylate of tris(hydroxy ethyl) isocyanurate.

Epoxy resins have an oxirane and are polymerized by the ring opening. Such epoxide resins include monomeric epoxy resins and oligomeric epoxy resins. Examples of some preferred epoxy resins include 2,2-bis[4-(2,3 -epoxypropoxy)-phenyl propane] (diglycidyl ether of bisphenol) and commercially available materials under the trade designation "Epon 828", "Epon 1004", and "Epon 1001F" available from Shell Chemical Co., "DER-331", "DER-332", and "DER-334" available from Dow Chemical Co. Other suitable epoxy resins include glycidyl ethers of phenol formaldehyde novolac (e.g., "DEN-431" and "DEN-428" available from Dow Chemical Co.).

The epoxy resins of the invention can polymerize via a cationic mechanism with the addition of an appropriate cationic curing agent. Cationic curing agents generate an acid source to initiate the polymerization of an epoxy resin. These cationic curing agents can include a salt having an onium cation and a halogen containing a complex anion of a metal or metalloid.

Other cationic curing agents include a salt having an organometallic complex cation and a halogen containing complex anion of a metal or metalloid which are further described in U.S. Pat. No. 4,751,138, which is incorporated herein by reference (column 6 line 65 to column 9 line 45). Another example is an organometallic salt and an onium salt is described in U.S. Pat. 4,985,340 (column 4 line 65 to column 14 line 50); European Published Patent Applications 306,161 and 306,162, all incorporated herein by reference. Still other cationic curing agents include an ionic salt of an organometallic complex in which the metal is selected from the elements of Periodic Group IVB, VB, VIB, VIIB and VIIIB which is described in European Published Patent Application No. 109,581 incorporated herein by reference.

Regarding free radical curable resins, in some instances it is preferred that the abrasive slurry further comprise a free radical curing agent. However in the case of an electron beam energy source, the curing agent is not always required because the electron beam itself generates free radicals.

Examples of free radical thermal initiators include peroxides, e.g., benzoyl peroxide, azo compounds, benzophenones, and quinones. For either ultraviolet or visible light energy source, this curing agent is sometimes referred to as a photoinitiator. Examples of initiators, that when exposed to ultraviolet light generate a free radical source, include but are not limited to those selected from the group consisting of organic peroxides, azo compounds, quinones, benzophenones, nitroso compounds, acryl halides, hydrozones, mercapto compounds, pyrylium compounds, triacrylimidazoles, bisimidazoles, chloroalkytriazines, benzoin ethers, benzil ketals, thioxanthones, and acetophenone derivatives, and mixtures thereof. Examples of initiators that when exposed to visible radiation generate a free radical source, can be found in U.S. Pat. No. 4,735,632, entitled Coated Abrasive Binder Containing Ternary Photoinitiator System, which is incorporated herein by reference. One suitable initiator for use with visible light is "Irgacure 369" commercially available from Ciba Geigy Corporation.

Additives

The abrasive slurry can further comprise optional additives, such as, for example, fillers (including grinding aids), fibers, lubricants, wetting agents, thixotropic materials, surfactants, pigments, dyes, antistatic agents, coupling agents, plasticizers, and suspending agents. The amounts of these materials are selected to provide the properties desired. The use of these can affect the erodability of the abrasive composite. In some instances an additive is purposely added to make the abrasive composite more erodable, thereby expelling dulled abrasive particles and exposing new abrasive particles.

The term filler also encompasses materials that are known in the abrasive industry as grinding aids. A grinding aid is defined as particulate material that the addition of which has a significant effect on the chemical and physical processes of abrading which results in improved performance. Examples of chemical groups of grinding aids include waxes, organic halide compounds, halide salts and metals and their alloys. The organic halide compounds will typically break down during abrading and release a halogen acid or a gaseous halide compound. Examples of such materials include chlorinated compounds like tetrachloronaphthalene, pentachloronaphthalene; and polyvinyl chloride. Examples of halide salts include sodium chloride, potassium cryolite, sodium cryolite, ammonium cryolite, potassium tetrafluoroboate, sodium tetrafluoroborate, silicon fluorides, potassium chloride, magnesium chloride. Examples of metals include, tin, lead, bismuth, cobalt, antimony, cadmium, iron titanium. Other miscellaneous grinding aids include sulfur, organic sulfur compounds, graphite and metallic sulfides.

Examples of antistatic agents include graphite, carbon black, vanadium oxide, humectants, and the like. These antistatic agents are disclosed in U.S. Pat. Nos. 5,061,294; 5,137,542, and 5,203,884; all incorporated herein by reference.

A coupling agent can provide an association bridge between the binder precursor and the filler particles or abrasive particles. Examples of coupling agents include silanes, titanates, and zircoaluminates. The abrasive slurry preferably contains anywhere from about 0.01 to 3% by weight coupling agent.

An example of a suspending agent is an amorphous silica particle having a surface area less than 150 meters square/gram that is commercially available from DeGussa Corp., under the trade name "OX-50".

Abrasive Composite Shape

Each abrasive composite has a shape associated with it. The shape has a surface or boundaries associated with it that results in one abrasive composite being separated to some degree from another adjacent abrasive composite. To form an individual abrasive composite, a portion of the planes or boundaries forming the shape of the abrasive composite must be separated from one another. This portion is generally the upper portion. The lower or bottom portion of abrasive composites abut next to one another. Referring to FIG. 1, adjacent abrasive composites 11 may be separated near the top surface 16 and abutted near the bottom surface 17. Referring to FIG. 2, a profile end sectional view of an abrasive composite array in an abrasive article 20 of the invention, adjacent abrasive composites 21 and 22 may be completely separated near their respective top surfaces or apexes 23 and 24, but not at their respective bottom surfaces 25 and 26. There are typically no open spaces between adjacent abrasive composites such that the backing is exposed. The backing 19 is the same as with FIG. 1.

The abrasive composite shape can be any shape. Typically the surface area of the base side of the shape that is in contact with the backing is larger in value than that of the distal end of the composite spaced from the backing. The shape of the composite can be selected from among a number of geometric shapes such as a cubic, cylindrical, prismatic, rectangular, pyramidal, truncated pyramidal, conical, truncated conical, post-like with a top surface which is flat. The resulting abrasive article can have a mixture of different abrasive composite shapes.

The preferred shape is a pyramid or a truncated pyramid. The pyramidal shape preferably has four to five sides if untruncated, and five to six sides if truncated (inclusive of the base side), although a larger number of sides is within the scope of the invention. Where a pyramidal or truncated pyramidal shape is used as the composite shape, the base side lengths generally can have a length of from about 100 to 500 micrometers.

The height of the composites is preferably to be constant across array of composites in the abrasive article, but it is possible to have composites of varying heights. The height of the composites generally can be a value up to about 200 micrometers, and more particularly in the range of about 25 to 200 micrometers.

It is preferred that the shape of the composite be precise or predetermined. Such a precise shape is illustrated in FIG. 1. The abrasive article 10 comprises a backing 19 and bonded to the backing are a plurality of abrasive composites 11 and 12, where composites 11 and 12 align in separate rows in the end sectional view of the abrasive article. The abrasive composites are each formed of a plurality of abrasive particles 14 dispersed in a binder 15. In this particular illustration, the abrasive composite has a pyramidal type shape. The planes 18 or boundaries 18 which define the pyramid are very sharp and distinct. The interaction of these well defined, sharp planes or shape boundaries define a precise shape. In one embodiment of the invention shown in FIG. 1, the abrasive composites are arranged in a staggered arrangement such that row of composites 11 are offset from the next row of composites 12 when viewed in the machine direction of the abrasive article.

Figure 3:
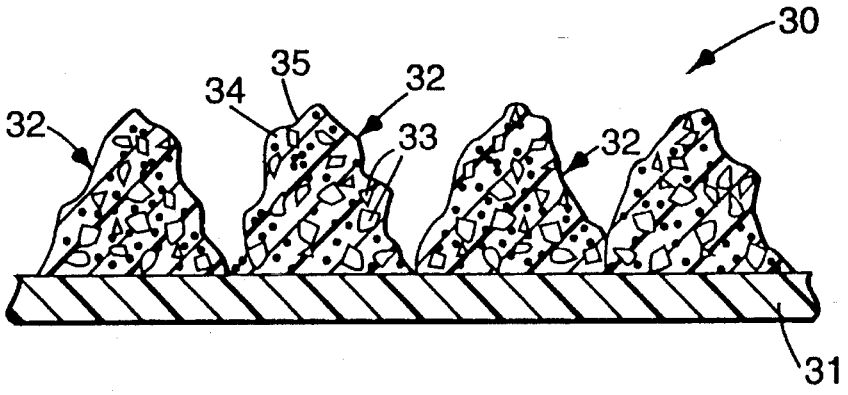
FIG. 3 is an enlarged end sectional view representing yet another embodiment of an abrasive article of this invention.

The abrasive composite shape can also be relatively inexact, irregular or imperfect. FIG. 3 illustrates an abrasive composite that has an irregular shape. The abrasive article 30 comprises a backing 31 and bonded to the backing is a plurality of abrasive composites 32. Inside the abrasive composites is a plurality of abrasive particles 33 dispersed in a binder 34. In this particular illustration, the abrasive composite has a pyramidal type shape. The boundaries 35 which define the pyramid are irregularly shaped.

The imperfect shape can be formed by the abrasive slurry flowing and distorting the initial shape prior to curing or solidification of the binder precursor. These non-straight, non-clear, non-reproducible, inexact or imperfect planes or shape boundaries is what it is meant by an irregular shape.

Each individual abrasive composite preferably has a cross-sectional surface area that decreases, preferably continuously, away from the backing towards the distal end, i.e., decreases in area size along its height direction in the direction proceeding away from the backing in the perspective of slices of the composite shape taken in a plane parallel to and vertically spaced from the plane of the backing. The height is the distance from the bottom, i.e., where the abrasive composite is bonded to the backing, to the top of the abrasive composite, i.e., the further most distance from the backing. This variable surface area results in a non-uniform pressure as the abrasive composite wears during use. During manufacture of the abrasive article, this variable surface area results in easier release of the abrasive composite from the production tool.

There are at least 1,200 individual abrasive composites/square centimeter, preferably at least about 3,000, more preferably at least about 4,600, even more preferably at least about 7,700 composites/cm$^2$ and most preferably at least 8,850 individual abrasive composites/square centimeter. A range of 1,200 to 10,000 abrasive composites/square centimeter is within the scope of the invention.

These area spacing numbers of abrasive composites have been surprisingly discovered to result in an abrasive article that has a relatively high rate of cut, while providing a relatively fine surface finish on the workpiece being abraded. Additionally, with this number of abrasive composites there is a relatively low unit force per each abrasive composite. In some instances, this can result in better, more consistent, breakdown of the abrasive composite.

Method of Making the Abrasive Article

The first step to make the abrasive article is to prepare the abrasive slurry. The abrasive slurry is made by combining together by any suitable mixing technique the binder precursor, the abrasive particles and the optional additives. Examples of mixing techniques include low shear and high shear mixing, with high shear mixing being preferred. Ultrasonic energy may also be utilized in combination with the mixing step to lower the abrasive slurry viscosity. Typically, the abrasive particles are gradually added into the binder precursor. The amount of air bubbles in the abrasive slurry can be minimized by pulling a vacuum either during or after the mixing step. In some instances it is preferred to heat, generally in the range of 30° to 70° C., the abrasive slurry to lower the viscosity. It is important the abrasive slurry be monitored before coating to ensure a rheology that coats well and in which the abrasive particles and other fillers do not settle before coating.

There are two general methods of making the abrasive article of this invention. The first method, which is the preferred method of the invention, generally results in an abrasive composite that has a precise shape. To obtain the precise shape, the binder precursor is solidified or cured while the abrasive slurry is present in cavities of a production tool. The second method generally results in an abrasive composite that has an irregular or nonprecise shape. In a second method, the abrasive slurry is coated into cavities of a production tool to generate the abrasive composites. However, the abrasive slurry is removed from the production tool before the binder precursor is cured or solidified. Subsequent to this, the binder precursor is cured or solidified. Since the binder precursor is not cured while in the cavities of the production tool this results in the abrasive slurry flowing and distorting the abrasive composite shape. However, in the second method, the cross-sectional area of the base of the composite shape of the composite after sagging, also is no smaller in size than that of the distal end.

In the above methods, if a thermosetting binder precursor is employed, the energy source can be thermal energy or radiation energy depending upon the binder precursor chemistry. For both methods, if a thermoplastic binder precursor is employed the thermoplastic is cooled such that it becomes solidified and the abrasive composite is formed.

Production Tool

The production tool has a surface which contains a plurality of cavities distending as indentations out of the main plane. These cavities are essentially the inverse shape of the abrasive composite and are responsible for generating the shape of the abrasive composites. There should be at least 1,200 cavities per square centimeter, preferably at least about 3,000; more preferably at least about 4,600; even more preferably at least about 7,700 composites/$cm^2$ and most preferably at least 8,850 cavities per square centimeter. A range of 1,200 to 10,000 cavity features/square centimeter is within the scope of the invention.

These numbers of cavities can be used to form the abrasive article having the required number of abrasive composites/square centimeter, as an array of abrasive composites is formed in counter correspondence to the array of cavities which shapes an abrasive slurry.

These cavities can have any geometric shape that is the inverse shape to the geometric shapes suitable for the abrasive composites, such as cubic, cylindrical, prismatic, hemispheric, rectangular, pyramidal, truncated pyramidal, conical, truncated conical, post-like with a top surface which is flat. The dimensions of the cavities are selected to achieve this desired number of abrasive composites/square centimeter. The cavities can be present in a dot like pattern where adjacent cavities butt up against one another at their portions where the indentations merge into a common planar major surface of the production sheet formed in the interstices of the cavities. Preferably, the shape of the cavities is selected such that the surface area of the abrasive composite decreases away from the backing.

The production tool can be a belt, a sheet, a continuous sheet or web, a coating roll such as a rotogravure roll, a sleeve mounted on a coating roll, or die. The production tool can be composed of metal, (e.g., nickel), metal alloys, or plastic. The metal production tool can be fabricated by any conventional technique such as engraving, hobbing, electroforming, diamond turning, and the like.

A thermoplastic tool can be replicated off a metal master tool. The master tool will have the inverse pattern desired for the production tool. The master tool is preferably made out of metal, e.g., a nickel-plated metal such as aluminum, copper or bronze. A thermoplastic sheet material optionally can be heated along with the master tool such that the thermoplastic material is embossed with the master tool pattern by pressing the two together. The thermoplastic material can also be extruded or cast onto to the master tool and then pressed. The thermoplastic material is cooled to a nonflowable state and then separated from the master tool produce a production tool.

The production tool may also contain a release coating to permit easier release of the abrasive article from the production tool. Examples of such release coatings include silicones and fluorochemicals.

Energy Sources

When the abrasive slurry comprises a thermosetting binder precursor, the binder precursor is cured or polymerized. This polymerization is generally initiated upon exposure to an energy source. Examples of energy sources include thermal energy and radiation energy. The amount of energy depends upon several factors such as the binder precursor chemistry, the dimensions of the abrasive slurry, the amount and type of abrasive particles and the amount and type of the optional additives. For thermal energy, the temperature can range from about 30° to 150° C., generally between 40° to 120° C. The time can range from about 5 minutes to over 24 hours. The radiation energy sources include electron beam, ultraviolet light, or visible light. Electron beam radiation, which is also known as ionizing radiation, can be used at an energy level of about 0.1 to about 10 Mrad, preferably at an energy level of about 1 to about 10 Mrad. Ultraviolet radiation refers to radiation having a wavelength within the range of about 200 to about 400 nanometers, preferably within the range of about 250 to 400 nanometers. It is preferred that 118 to 236 Watt/cm ultraviolet lights are used. Visible radiation refers to radiation having a wavelength within the range of about 400 to about 800 nanometers, preferably in the range of about 400 to about 550 nanometers.

Figure 4:
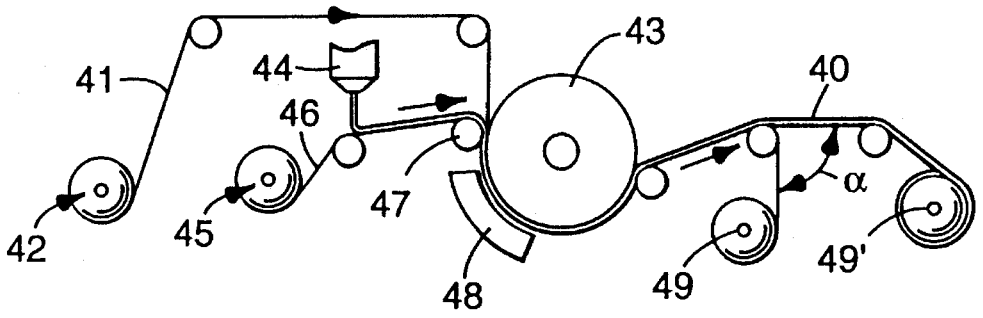
FIG. 4 is a side view representing a system for making an abrasive article according to this invention.

The first method, which is preferred, is illustrated in FIG. 4. Backing 41 leaves an unwind station 42 and at the same time the production tool (pattern tool) 46 leaves an unwind station 45. Production tool 46 is coated with abrasive slurry by means of coating station 44. It is possible to heat the abrasive slurry and/or subject the slurry to ultrasonics prior to coating to lower the viscosity. The coating station can be any conventional coating means such as drop die coater, knife coater, curtain coater, vacuum die coater or a die coater. During coating the formation of air bubbles should be minimized. The preferred coating technique is a vacuum fluid bearing die, such as described in U.S. Pat. Nos. 3,594,865; 4,959,265 and 5,077,870, which are incorporated herein by reference.

After the production tool is coated, the backing and the abrasive slurry are brought into contact by any means such that the abrasive slurry wets the front surface of the backing. In FIG. 4, the abrasive slurry is brought into contact with the backing by means of contact nip roll 47. Next, contact nip roll 47 also forces the resulting construction against support drum 43. Next, some form of energy is transmitted into the abrasive slurry to at least partially cure the binder precursor by energy source 48.

The term partial cure is meant that the binder precursor is polymerized to such a state that the abrasive slurry does not flow when inverted in the tool. The binder precursor can be fully cured once it is removed from the production tool by any convenient energy source. Following this, the production tool is rewound on mandrel 49 so that the production tool can be reused again. Additionally, abrasive article 40 is wound on mandrel 49'. The angle alpha ($\alpha$) is an angle effective to separate the production tool and abrasive article.

If the binder precursor is not fully cured, the binder precursor can then be fully cured by either time and/or exposure to an energy source. Additional steps to make the abrasive article according to this first method is further described in U.S. Pat. No. 5,152,917 and U.S. Ser. No. 08/004,929 filed Jan. 14, 1993, which are incorporated herein by reference.

In another variation of this first method, the abrasive slurry can be coated onto the backing and not into the cavities of the production tool. The abrasive slurry coated backing is then brought into contact with the production tool such that the abrasive slurry flows into the cavities of the production tool. The remaining steps to make the abrasive article are the same as detailed above.

Relative to this first method, it is preferred that the binder precursor is cured by radiation energy. The radiation energy can be transmitted through the backing or through the production tool. The backing or production tool should not appreciably absorb the radiation energy. Additionally, the radiation energy source should not appreciably degrade the backing or production tool. For instance ultraviolet light can be transmitted through a polyester backing. Alternatively, if the production tool is made from certain thermoplastic materials, such as polyethylene, polypropylene, polyester, polycarbonate, poly(ether sulfone), poly(methyl methacrylate), polyurethanes, polyvinylchloride, or combinations thereof, ultraviolet or visible light can be transmitted through the production tool and into the abrasive slurry. The more deformable material results in easier processing. For thermoplastic based production tools, the operating conditions for making the abrasive article should be set such that excessive heat is not generated. If excessive heat is generated, this may distort or melt the thermoplastic tooling.

Figure 5:
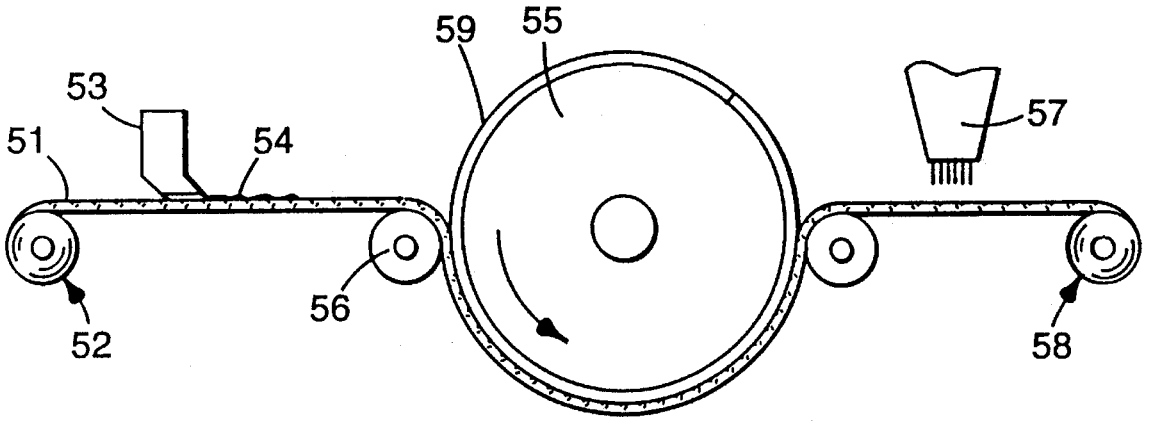
FIG. 5 is a side view representing another system for making an abrasive article according to this invention.

A second method for making the abrasive article of the invention is illustrated in FIG. 5. Backing 51 leaves an unwind station 52 and the abrasive slurry 54 is coated onto the front surface of the backing by means of the coating station 53. The abrasive slurry can be coated onto the backing by any technique such as drop die coater, roll coated, knife coater, curtain coater, vacuum die coater, or a die coater. Again, it is possible to heat the abrasive slurry and/or subject the slurry to ultrasonics prior to coating to lower the viscosity. During coating the formation of air bubbles preferably should be minimized, by means and techniques referred to hereinabove.

Next, the backing and the abrasive slurry are brought into contact with production tool 59 by a nip roll 56 such that the abrasive slurry fills the cavities of the production tool. The production tool can be provided in sheet form and welded at its free ends to form an endless sleeve which can be heat shrunk fit upon an outer surface of drum 55. Next, the abrasive slurry coated backing is removed from the production tool. Upon removal the abrasive slurry will have a pattern associated with it; the pattern of abrasive composites is formed from the cavities in the production tool. Following removal, the abrasive slurry coated backing is exposed to an energy source 57 to initiate the polymerization of the binder precursor and thus forming the abrasive composites. After curing, the resulting abrasive article is wound onto a roll at station 58. It is generally preferred that the time between release of the abrasive slurry coated backing from the production tool to curing of the binder precursor is relatively minimal. If this time is too long, the abrasive slurry will flow and the pattern will distort to such a degree that there are not at least 1,200 abrasive composites per square centimeter.

In another variation of this second method, the abrasive slurry can be coated into the cavities of the production tool and not onto the backing. The backing is then brought into contact with the production tool such that the abrasive slurry wets and adheres to the backing. The remaining steps to make the abrasive article are the same as detailed above.

After the abrasive article is made, it can be flexed and/or humidified prior to converting. The abrasive article can be converted into any desired form such as a cone, endless belt, sheet, disc, etc. before the abrasive article is used.

Method of Refining a Workpiece Surface

In another embodiment of this invention pertains to a method of refining a workpiece surface. This method involves bringing into frictional contact the abrasive article of this invention with a workpiece. The term refine means that a portion of the workpiece is abraded away by the abrasive article. Additionally, the surface finish associated with the workpiece surface is reduced after this refining process. One typical surface finish measurement is Ra; Ra is the arithmetic mean of the departures of the surface profile from the mean surface profile, as measured in micrometers. The surface finish can be measured by a profilometer, such as those sold under the tradename Perthometer or Surtronic.

Workpiece

The workpiece can be any type of material such as metal, metal alloys, exotic metal alloys, ceramics, glass, wood, wood like materials, composites, painted surface, plastics, reinforced plastic, stones, and combinations thereof. The workpiece may be flat or may have a shape or contour associated with it. Examples of workpieces include plastic or glass lens blanks, plastic lenses, glass television screens, metal automotive components, plastic components, particle board, cam shafts, crank shafts, furniture, turbine blades, painted automotive components, magnetic media, and the like.

Depending upon the application, the force at the abrading interface can range from about 0.1 kg to over 1000 kg. Generally this range is between 1 kg to 500 kg of force at the abrading interface. Also depending upon the application, there may be a liquid present during abrading. This liquid can be water and/or an organic compound. Examples of typical organic compounds include lubricants, oils, emulsified organic compounds, cutting fluids, soaps, or the like. These liquids may also contain other additives such as defoamers, degreasers, corrosion inhibitors, or the like. The abrasive article may oscillate at the abrading interface during use. In some instances, this oscillation may result in a finer surface on the workpiece being abraded.

The abrasive article of the invention can be used by hand or used in combination with a machine. At least one or both of the abrasive article and the workpiece is moved relative to the other. The abrasive article can be converted into a belt, tape rolls, disc, sheet, and the like. For belt applications, the two free ends of an abrasive strip are joined together and a splice is formed at the joined ends. It is possible to provide a spliceless belt like that described in co-pending U.S. patent application Ser. No. 07/919,541 filed Jul. 24, 1992. Generally the endless abrasive strip traverses over at least one idler roll and a platen or contact wheel. The hardness of the platen or contact wheel is adjusted to obtain the desired rate of cut and workpiece surface finish. The abrasive belt speed ranges anywhere from about 2.5 to 80 meters per second, generally between 8 to 50 meters per second. Again, this belt speed depends upon the desired cut rate and surface finish. The belt dimensions can range from about 5 mm to 1,000 mm wide and from about 50 mm to 10,000 mm long. Abrasive tapes are continuous lengths of the abrasive article. They can range in width from about 1 mm to 1,000 mm, generally between 5 mm to 250 mm. The abrasive tapes are usually unwound, traverse over a support pad that forces the tape against the workpiece and then rewound. The abrasive tapes can be continuously fed through the abrading interface and can be indexed. The abrasive disc, which also includes what is known in the abrasive art as "daisies", can range from about 50 mm to 1,000 mm in diameter. Typically, abrasive discs are secured to a back-up pad by an attachment means. These abrasive discs can rotate between 100 to 20,000 revolutions per minute, typically between 1,000 to 15,000 revolutions per minute.

The following non-limiting examples will further illustrate the invention. All parts, percentages, ratios, etc, in the examples are by weight unless otherwise indicated.

EXAMPLES

The following abbreviations are used throughout:

TMPTA: trimethylol propane triacrylate;

TATHEIC: triacrylate of tris (hydroxy ethyl) isocyanurate;

PH1: 2,2-dimethoxy-1,2-diphenyl-1-ethanone, commercially available from Ciba Geigy Corp. under the trade designation "Irgacure 651";

PH2: 2-benzyl-2-N,N-dimethylamino-1-(4 -morpholinophenyl)-1-butanone, commercially available from Ciba Geigy Corp. under the trade designation "Irgacure 369";

PH3: 2-methyl-1-[4-(methylthio)phenyl]-2 -morpholinopropanone-1, commercially available from Ciba Geigy Corp., under the trade designation "Irgacure 907", PC4: clay, commercially available from R. T. Vanderbilt Company, Inc., under the designation "Peerless #4";

ASF: amorphous silica filler, commercially available from DeGussa under the trade designation "OX-50";

ALS: Aluminum silicate, tradename P820, commercially available from DeGussa.

WAO: white aluminum oxide;

SCA: silane coupling agent, 3 -methacryloxypropyl-trimethoxysilane, commercially available from Union Carbide under the trade designation "A-174";

THF: Tetrahydrofurfuryl acrylate

ROC: hydroxy propyl methacrylate, commercially available from Rohn and Haas, under the trade designation "Rocryl 410™".

ITX: Isopropylthioxanthane commercially available from Biddle-Sawyer Corp.

Test Procedure 1

Test Procedure 1 was designed to test the cut and finish of the abrasive article for paint panels. The abrasive article was cut to about a 5.7 cm by 22.85 cm sheet. The sheets were cut in a manner such that the pattern of composites was primarily parallel, perpendicular, and at a 45 degree angle to the length of the sheet. The workpiece was a 114 cm by 77 cm metal plate having a paint primer thereon which is commonly used in the automotive paint industry. The coated abrasive article was used to abrade, by hand, the workpiece. The movement of the operator's hand in a back and forth manner constituted a stroke.

Test Procedure 2

Test Procedure 2 was designed to test the abrasive article for ophthalmic lens polishing. The abrasive samples were cut into 3 inch (about 7.6 cm) diameter "daisies". The lens workpiece was made of "CR-39" plastic, available from Pittsburgh Paint and Glass Co. (PPG), Pittsburgh, Pa. It was 68 mm in diameter and was pre-ground to a 212 spherical curve (2.12 diopters). The machine used was a Coburn 506 cylinder (polishing) machine, available from Coburn Opthalmic Industries, Inc., Muskogee, Okla. The test was run with water (flooding) as a lubricant. There was 20 pounds force (about 4.5 Newton) of the abrasive on the workpiece and the lapping time was one minute.

Test Procedure 3

Test Procedure 3 was designed to test the abrasive article for ophthalmic lens polishing. The abrasive samples were cut with a standard die into 3 inch (about 7.6 cm) diameter "daisies". The lens workpiece was made of "CR-39" plastic, available from Pittsburgh Paint & Glass (PPG), Pittsburgh, Pa. USA. It was 68 mm in diameter and was pre-ground to a 212 spherical curve (2.12 Diopter). The backside of the abrasive material to be tested was laminated with a pressure-sensitive adhesive and adhered over a lapping block. The lapping machine used was a Coburn 5000 cylinder machine, available from Coburn Optical Industries, Inc., Muskogee, Okla. USA, with a setting of 20 pounds force (about 4.5 Newton) used to urge the lap means and abrasive article against the surface of the lens workpiece. The lap block and lens was flooded with water during polishing. The water flooding was effected by projecting a continuous stream of water into the interface of the contacting lap block and lens workpiece.

A one step fining operation was first performed. The lens was fined for two minutes with a 4 micrometer aluminum oxide beaded lapping film commercially available from Minnesota Mining and Manufacturing under the trade designation 3M 356M Qwik Strip™ fining pad. The exemplary abrasive article material, described below, was then used to polish the lens for two minutes under the same conditions as the second fining step.

Test Procedure 4

The abrasive article was converted into a disc (12.7 cm diameter) and secured to a foam back-up pad by means of a pressure sensitive adhesive. The abrasive disc/back-up pad assembly was installed on a Schiefer testing machine and the abrasive disc used to abrade a workpiece made of polymethyl methacrylate polymer (PLEXIGLASS). A load of 4.5 kg was applied to the abrasive disc and all of the testing was conducted beneath a water flood. The endpoint of the testing was 500 revolutions or cycles of the abrasive disc. The polymethyl methacrylate was weighed before and after the test to determine the amount of material abraded away by the disc.

Ra

Ra is a common measure of roughness used in the abrasives industry. Ra is defined as the arithmetic mean of the departures of the roughness profile from the mean line. Ra is measured with a profilometer probe, which is a diamond tipped stylus. In general, the lower the Ra, the smoother the finish. The results are recorded in micrometers. The profilometer used was a Perthen M4P.

Rtm

Rtm is a common measure of roughness used in the abrasives industry. Rtm is defined as the mean of five individual roughness depths of five successive measuring lengths, where an individual roughness depth is the vertical distance between the highest and lowest points in a measuring length. Rtm is measured in the same manner as Ra. The results are recorded in micrometers. In general, the lower the Rtm, the smoother the finish. The profilometer used was a Perthen M4P with a 0.005 mm radius tip and an 8 mm measuring stroke.

Example 1 and Comparative Example A

Example 1

There was combined 64 parts of 50:50:2 TATHEIC:TMPTA:PH1, respectively, 47 parts PC4, 289 parts WAO (6.7 micrometer average particle size), 4 parts SCA, and 81.96 parts of 100:2 ROC:PH1, respectively, were mixed to form an abrasive slurry. The abrasive slurry was coated onto a nickel plated production tool having a pyramidal type pattern such that the abrasive slurry filled recesses in the tool. The pyramidal pattern was such that their bases were butted up against one another. The height of the pyramids was about 63.5 micrometers and there were provided approximately 8,850 cavities for forming abrasive composites in the surface of the production tool per square centimeter.

A film backing was pressed against the production tool by means of a spreader and the abrasive slurry wetted the front surface of the backing. The backing used was a 130 micrometer thick polyester theraphthalate film with a 20 micrometer thick coating of ethylene acrylic acid copolymer on the front surface. The article was cured by passing the tool together with the backing and binder precursor under two mercury type H lamps on high power. The radiation passed through the film backing. The speed was about 7.3 meters per minute and four passes. This ultraviolet light resulted in the abrasive slurry being transformed into an abrasive composite and the abrasive composite being adhered to the polyester film substrate. Next, the polyester film/abrasive composite construction was separated from the production tool to form an abrasive article.

Comparative Example A

Comparative Example A was produced by the same procedure as Example 1 except that the height of the pyramids was about 176 micrometers and there were approximately 1,129 cavity features per square centimeter in the face of production tool. Table 1 shows the results from Example 1 and Comparative Example A when tested by Test Procedure 1 on OEM base coat/clear coat paint.

The orientations "parallel", "perpendicular" and "45 degrees" indicate the orientation of the lines of abutment between rows of abrasive composites during abrading relative to the machine direction of the abrasive article. For instance, a "parallel" direction means the lines of abutment are arranged parallel to the machine direction of the abrasive article during abrading.

TABLE 1

| | 10 strokes | | 90 strokes | |
|---|---|---|---|---|
| | Ra | Rtm | Ra | Rtm |
| Example 1 | | | | |
| parallel | 0.025 | 0.386 | 0.051 | 1.036 |
| perpendicular | 0.030 | 0.594 | 0.025 | 0.762 |
| 45 degrees | 0.020 | 0.432 | 0.041 | 1.082 |
| Comparative Example A | | | | |
| parallel | 0.036 | 0.798 | 0.132 | 2.230 |
| perpendicular | 0.015 | 0.335 | 0.061 | 0.752 |
| 45 degrees | 0.046 | 0.569 | 0.056 | 0.671 |

Comparative Example A produced a grooved or scribed result in the parallel mode. The finish produced by Example 1 with 8,850 composites/cm$^2$ was generally superior, with only several exceptions, in the surface finish imparted as compared to the comparison example having 1,129 composites/cm$^2$ regardless of the orientation of the abrasive composites in the abrasive article relative to the machine direction.

Example 2 and Comparative Example B

Example 2

Example 2 was prepared in the same method as Example 1, except that 60 parts of 50:50:2 TATHEIC:TMPTA:PH1, respectively, 10.5 parts PC4, 210 parts WAO (6.7 micrometer average particle size), 3 parts SCA, and 15 parts methyl ethyl ketone were mixed to form the abrasive slurry. The height of the pyramids in the production tool was about 89 micrometers and there were approximately 4,515 cavity features per square per square centimeter. The film backing used was about 100 micrometers thick with a 20 micrometer ethylene acrylic acid copolymer coating on the front surface.

Comparative Example B

Comparative Example B was prepared in the same method as Comparative Example A except that 24.2 parts of 50:50:2 TATHEIC:TMPTA:PH1, respectively, 6.9 parts PC4, 68.9 parts WAO (40 micrometer average particle size), and 1 (one) part SCA were mixed to form the abrasive slurry. The height of the pyramids in the production tool was about 176 micrometers and there were approximately 1,129 cavity features per square centimeter. The film backing used was about 100 micrometers thick with a 20 micrometer ethylene acrylic acid copolymer coating on the front surface. To investigate the consistency in surface finish provided by the examples at the three different orientations of the lines of abutment between composites with the machine direction of parallel, perpendicular and 45 degrees, two separate samples, designated samples (1) and (2), were tested for each example at each orientation. Table 2 shows the results from Example 2 and Comparative Example B when tested by Test Procedure 1 on K-200 primer paint.

TABLE 2

| | 10 strokes | | 90 strokes | | 90 strokes, cut |
|---|---|---|---|---|---|
| | Ra | Rtm | Ra | Rtm | (micrometers) |
| Example 2 | | | | | |
| parallel (1) | 0.22 | 1.59 | 0.12 | 1.00 | 17.8 |
| parallel (2) | 0.14 | 1.05 | 0.08 | 0.74 | 12.2 |
| perp. (1) | 0.13 | 1.07 | 0.10 | 0.82 | 14.2 |
| perp. (2) | 0.18 | 1.45 | 0.11 | 1.33 | 16.8 |
| 45 degr. (1) | 0.15 | 1.31 | 0.10 | 1.37 | 20.3 |
| 45 degr. (2) | 0.17 | 1.36 | 0.10 | 0.97 | 15.2 |
| Comparative Example B | | | | | |
| parallel (1) | 3.76 | 16.2 | 7.44 | 38.71 | 22.4 |
| parallel (2) | 3.53 | 17.0 | 10.39 | 52.48 | 17.8 |
| perp. (1) | 1.22 | 7.3 | 2.74 | 12.01 | 82.8 |
| perp. (2) | 2.95 | 14.7 | 18.11 | 62.81 | 51.8 |
| 45 degr. (1) | 0.99 | 5.8 | 0.84 | 5.08 | 95.0 |
| 45 degr. (2) | 1.04 | 6.5 | 0.58 | 4.83 | 84.8 |

The results show that the abrasive article of the invention of Example 2 having 4,515 composites/cm$^2$ provided a superior finish, less dependence of orientation for finished cut rate, and performed more consistently in separate runs than that of the comparative abrasive article having only 1,129 composites/cm$^2$.

Example 3 and Comparative Examples C and D

Example 3

For Example 3, 14 parts TATHEIC, 14 parts TMPTA, 1 (one) part PH2, 1 (one) part ASF, 69 parts WAO (12 micrometer average particle size), and 1 (one) part SCA were mixed to form an abrasive slurry. The abrasive slurry was coated onto a transparent polymeric production tool having the same topography as in Example 1. A 130 micrometer polyester theraphthalate film backing was pressed against the production tool by means of a roller and the abrasive slurry wetted the front surface of the backing. The backing used was a 130 micrometer thick with a 20 micrometer thick coating of ethylene acrylic acid copolymer on the front surface. The article was cured by passing the tool together with the backing and binder precursor under a visible light lamp ("V" type, 236 Watt/cm, available from Fusion Systems) on high power. The radiation energy was transmitted through the polymeric tooling. The speed was about 15.25 meters per minute. This resulted in the abrasive slurry being transformed into an abrasive composite and the abrasive composite being adhered to the polyester film substrate. Next, the polyester film/abrasive composite construction was separated from the production tool to form an abrasive article.

Comparative Example C

Comparative Example C was produced by the same procedure as Example 3 except that the tool used was the same as in Comparative Example A except that it was a transparent polymeric tool.

Comparative Example D

Comparative Example D was a 12 micrometer aluminum oxide agglomerate coated abrasive commercially available from 3M Company under the trade designation "CSF Gold". Table 3 shows the results when Example 3 and Comparative Examples C and D were tested according to Test Procedure 2.

TABLE 3

| | Ra |
|---|---|
| Example 3 | 0.148 |
| Comparative C | 0.203 |
| Comparative D | 0.268 |

The results show that the abrasive article of the invention of Example 3 having 8,850 composites/cm$^2$ provided a superior finish than the comparative abrasive articles having less than 1,200 composites or agglomerates/cm$^2$.

Example 4 and Comparative Example E

Example 4

Example 4 was produced by the same procedure as Example 3 except that the WAO had an average particle size of 1 micrometer.

Comparative Example E

Comparative Example E was produced by the same procedure as Comparative Example C except that the WAO had an average particle size of 1 micrometer. Table 4 shows the results when Example 4 and Comparative Example E were tested according to Test Procedure 2.

TABLE 4

| | Rtm |
|---|---|
| Example 4 | 0.240 |
| Comparative E | 0.293 |

The results show that the abrasive article of the invention of Example 4 having 8,850 composites/cm$^2$ provided a superior finish than the comparative abrasive article having less than 1,200 composites/cm$^2$.

Example 5 and Comparative Examples F, G, and H

Example 5

Example 5 was produced by the same procedure as Example 3 except that 42 parts of 70:30 TMPTA:TATHEIC, respectively, 2 parts PH2, 1 (one) part ASF, 54 parts WAO (2 micrometer average particle size), and 1 (one) part SCA were mixed to form the abrasive slurry. The backing used was a 375 micrometer thick paper.

Comparative Example F

Comparative Example F was produced by the same procedure as Example 5 except that the polymeric tooling topography was an evenly spaced array of post-like structures that were about 75 micrometers high and about 130 micrometers in diameter with about 872 cavity features per square centimeter.

Comparative Example G

Comparative Example G was produced by the same procedure as Example 5 except that the polymeric tooling topography was an evenly spaced array of post-like structures that were about 75 micrometers high and about 130 micrometers in diameter with about 190 cavity features per square centimeter.

Comparative Example H

Comparative Example H was produced by the same procedure as Example 5 except that the polymeric tooling topography was an evenly spaced array of cross-like structures that were about 75 micrometers high and with radial arms about 203 micrometers in length and about 50 micrometers thick, with about 6 cavity features per square centimeter.

Table 5 shows the results when Example 5 and Comparative Examples F, G, and H were tested according to Test Procedure 3.

TABLE 5

| | Rtm |
|---|---|
| Example 5 | 0.270 |
| Comparative F | 0.305 |
| Comparative G | 0.383 |
| Comparative H | 0.458 |

The results show that the abrasive article of the invention of Example 4 having 8,850 composites/cm$^2$ provided a superior finish than the comparative abrasive articles having less than 1,200 composites/cm$^2$.

Example 6 and Comparative Examples I and J

There was combined 215.8 parts of 27.5:27.5:45:2:1 TATHEIC:TMPTA:THF:PH3:ITX, respectively, and 56.7 parts PC4, 415.5 parts WAO (5.5 micrometer average particle size), 6 parts SCA, and 12 parts ALS were mixed to form an abrasive slurry.

The abrasive slurry was coated onto a plated production tool, as in Example 1, having a pyramidal type pattern such that the abrasive slurry filled recesses in the tool. The pyramidal pattern was such that their bases were butted up against one another. The height of the pyramids was about 63.5 micrometers and there were provided approximately 8,850 cavities per square centimeter.

The procedure was the same as in Example 1 except that the article was cured by passing the tool together with the backing and binder precursor under one 600 Watt (236 watt/cm) type D lamp on high power. The speed was about 61 meters per minute with four passes.

Comparative Example I

Comparative Example I was produced by the same procedure as Example 6 except that the height of the pyramids was about 176 micrometers and there were approximately 1,129 cavity features per square centimeter in the face of production tool.

Comparative Example J

Comparative Example J was produced by the same procedure as Comparative Example I except for the following different cure conditions. For this example, after two passes at 18.3 meters/minute were completed, the sample was flipped over and two more passes at 18.3 meters/minute were performed. This was done to ensure as complete a cure as possible of the thicker sample was performed to eliminate this factor as a variable in the results.

Table 6 shows the Rtm and cut results from Example 6 and Comparative Examples I and J. The cut tests were conducted by Test Procedure 4. The Rtm and cut results for each example is based on the average of four runs on four different samples of each example. The standard deviations of the cut results for the runs of each example also are reported in Table 6.

TABLE 6

| | Rtm | cut (g) | std. dev. |
|---|---|---|---|
| Example 6 | 0.65 | 0.44500 | 0.01707 |
| Comp. Example I | 0.76 | 0.24475 | 0.03892 |
| Comp. Example J | 0.75 | 0.27850 | 0.03601 |

As seen in the results, the surface finish, cut and consistency of the abrasive article of the invention is superior in all respects to that of the comparison examples.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. An abrasive article comprising a sheet-like structure having a major surface and having deployed in a fixed position thereon a plurality of abutting abrasive composites in an area spacing of at least 1,200 composites/cm$^2$, each of said composites comprising a plurality of abrasive particles dispersed in a binder.

2. The abrasive article of claim 1, wherein said plurality of composites are deployed in an area spacing of at least about 3,000 abrasive composites/cm$^2$.

3. The abrasive article of claim 1, wherein said plurality of composites are deployed in an area spacing of at least about 4,600 abrasive composites/cm$^2$.

4. The abrasive article of claim 1, wherein said plurality of composites are deployed in an area spacing of at least about 7,700 abrasive composites/cm$^2$.

5. The abrasive article of claim 1, wherein said plurality of composites are deployed in an area spacing of at least about 8,850 abrasive composites/cm$^2$.

6. The abrasive article of claim 1, wherein said plurality of composites are deployed in an area spacing of from 1,200 to 10,000 abrasive composites/cm$^2$.

7. The abrasive article of claim 1, wherein each said composite has a precise shape defined by a distinct and discernible boundary.

8. The abrasive article of claim 1, wherein said composites each has a precise three-dimensional shape defined by a distinct and discernible boundary, wherein said plurality of abutting composites all have an identical three-dimensional shape.

9. The abrasive article of claim 1, wherein each said composite has a geometrical shape selected from pyramidal shape and truncated pyramidal shape.

10. The abrasive article of claim 1, wherein each said composite has a truncated pyramidal shape.

11. The abrasive article of claim 1, wherein said composite has a shape selected from the group consisting of pyramidal and truncated pyramidal, wherein said shape comprises a base side in contact with said major surface bounded by base side edges having lengths from about 100 to 500 micrometers.

12. The abrasive article of claim 1 wherein said plurality of composites are deployed in an area spacing between about 4,515 abrasive composites/cm$^2$ to 10,000 abrasive composites/cm$^2$.

13. The abrasive article of claim 1, wherein each said composite comprises a precise, three-dimensional shape including (i) a base side in planar contact with said major surface, said base side having a first cross-sectional area, and (ii) a distal end spaced from said base side having a second cross-sectional area.

14. The abrasive article of claim 13, wherein said first cross-sectional area is greater than said second cross-sectional

15. The abrasive article of claim 13, wherein said precise, three-dimensional shape comprises a tapered shape.

16. The abrasive article of claim 13, wherein each said composite has substantially a same height as measured between said base said and said distal end.

17. The abrasive article of claim 16, wherein said same height is between about 25 and 200 micrometers.

18. An abrasive belt article comprising an endless sheet-like structure having a major surface and having deployed in a fixed position thereon a plurality of abutting abrasive composites in area spacing of at least 1,200 composites/cm$^2$, each of said composites comprising a plurality of abrasive particles dispersed in a binder.

* * * * *